US005584685A

United States Patent [19]

Yamada et al.

[11] Patent Number: 5,584,685

[45] Date of Patent: Dec. 17, 1996

[54] DISCHARGE-TYPE IGNITION DEVICE FOR OIL BURNER

[75] Inventors: Toshihiko Yamada; Masanori Kawamura, both of Aichi-ken, Japan

[73] Assignee: Toyotomi Co., Ltd., Aichi-ken, Japan

[21] Appl. No.: 455,211

[22] Filed: May 31, 1995

[51] Int. Cl.[6] ..... F23D 3/28

[52] U.S. Cl. ..... 431/304; 431/255; 431/257; 431/315; 126/96

[58] Field of Search ..... 431/302, 304, 431/305, 306, 307, 254–257, 315, 308, 259, 263, 320, 344, 153; 126/95, 96

[56] References Cited

U.S. PATENT DOCUMENTS 4,422,845 12/1983 Yamaguchi ..... 431/153
4,428,729 1/1984 Takiro ..... 431/263
4,486,170 12/1984 Tsukada ..... 431/153
5,030,085 7/1991 Yamada et al. ..... 126/96
5,413,479 5/1995 Nakanishi et al. .

FOREIGN PATENT DOCUMENTS 63-35244 9/1988 Japan .

*Primary Examiner*—Larry Jones
*Attorney, Agent, or Firm*—Pollock, Vande Sande & Priddy

[57] ABSTRACT

A discharge-type capable of accomplishing ignition of a wick at a position convenient or suitable for the ignition. Spark discharge for ignition of a wick is started in the course of raising of the wick. Thus, any possible variation in height of the wick and deformation of the wick due to wear do not adversely affects ignition of the wick, because the ignition is carried out when a gap between the wick being raised and the discharge electrode is rendered optimum for the ignition. This permits a dry cell to be satisfactorily used as a power supply for the ignition.

4 Claims, 4 Drawing Sheets

DISCHARGE-TYPE IGNITION DEVICE FOR OIL BURNER

BACKGROUND OF THE INVENTION

This invention relates to a discharge-type ignition device for an oil burner, and more particularly to a discharge-type ignition device for an oil burner which is adapted to carry out ignition of a wick of the oil burner by electric discharge.

Conventionally, a filament-type ignition device has been commonly used for igniting a wick of an oil burner, which is generally constructed so as to red-heat a filament by means of a dry cell acting as a power supply, to thereby permit the red-heated filament to ignite the wick of the oil burner.

Further, a discharge-type ignition device for an oil burner is also known in the art. The discharge-type ignition device is classified into an ignition device which uses combustion heat generated from an oil burner as a heat source and a commercial AC 100 V power supply as a power supply for the ignition device and an ignition device which uses a battery means such as a dry cell as a power supply therefor.

The latter discharge-type ignition device using a battery or dry cell as a power source for electric or spark discharge is disclosed in Japanese Utility Model Publication No. 35244/1988. Unfortunately, it fails to be put into practice due to various disadvantages. Such a conventional discharge-type ignition device using a dry cell as disclosed includes discharge electrodes arranged so as to be spaced from each other with a combustion wick being interposedly positioned therebetween.

The present invention is directed to a discharge-type ignition device of the latter type which uses a battery or a dry cell as a power supply to carry out spark discharge between discharge electrodes, to thereby ignite a wick.

The conventional discharge-type ignition device using a dry cell as the power supply has a disadvantage that the dry cell fails to permit spark discharge sufficient for ignition of a wick of an oil burner to occur between discharge electrodes. Also, the conventional discharge-type ignition device using a dry cell causes a variation in height of the wick, a deterioration in surface of the wick due to settling of the wick, adhesion of tar to the wick or the like, and deformation of the wick with lapse of time, resulting in a variation in dimension or distance between the wick and the discharge electrodes. This causes spark generated by discharge to be deviated from the wick, leading to a failure in ignition of the wick and/or generation of white fume of fuel oil from the wick. This would be the reason why the conventional discharge-type ignition device using a dry cell fails to be put into practice.

Thus, an ignition device for an oil burner which is currently commercially available is limited to the above-described filament-type ignition device.

In view of the foregoing disadvantage, the assignee proposed a discharge-type ignition device for an oil burner which is constructed so as to generate spark discharge in the course of upward movement of a wick for ignition to a normal combustion position, to thereby ensure positive ignition of the wick while permitting a dry cell to be satisfactorily used for the spark discharge, as disclosed in U.S. patent application Ser. No. 08/187,318 now U.S. Pat. No. 5,413,479, May 9, 1995. The discharge-type ignition device proposed smoothly or positively accomplishes ignition of the wick by spark discharge, because it can eliminate the above-described disadvantage of the prior art and is inherently free of a disadvantage of a filament-type ignition device that a filament is readily exhausted, deformed and/or broken.

Nevertheless, it is still highly desirable to develop a discharge-type ignition device which is further simplified in structure and reduced in manufacturing cost.

SUMMARY OF THE INVENTION

The present invention has been made in view of the foregoing disadvantages of the prior art while taking notice of the fact that as a result of a further study by the inventors, a discharge-type ignition device which is constructed so as to move a wick to a position above a normal combustion position for the purpose of ignition permits a structure thereof to be further simplified and a manufacturing cost thereof to be further decreased and exhibits an ignition performance sufficient to readily and positively redeem a failure in ignition of a wick while substantially ensuring the advantages of the ignition device disclosed in the above-described U.S. Patent application.

Accordingly, it is an object of the present invention to provide a discharge-type ignition device for an oil burner which is capable of smoothly and positively carrying out ignition of a wick by spark discharge.

It is another object of the present invention to provide a discharge-type ignition device for an oil burner which is capable of effectively accomplishing ignition of a wick even when spark discharge for the ignition is weak, to thereby permit a small-sized power supply such as a dry cell to be satisfactorily used for the spark discharge.

It is a further object of the present invention to provide a discharge-type ignition device for an oil burner which is capable of exhibiting an ignition performance sufficient to readily and positively redeem a failure in ignition of a wick.

It is still another object of the present invention to provide a discharge-type ignition device for an oil burner which is capable of substantially constantly maintaining a wick within an ignition range when ignition of the wick is to be carried out.

It is even another object of the present invention to provide a discharge-type ignition device for an oil burner which is capable of accomplishing the above-described objects while ensuring simplification in construction and a decrease in manufacturing cost.

In accordance with the present invention, a discharge-type ignition device is provided for an oil burner which includes a wick receiving cylinder structure including an inner cylindrical member and an outer cylindrical member arranged so as to be spaced from each other with a space being defined therebetween. The discharge-type ignition device includes a wick vertically movably arranged in the space of the wick receiving cylinder structure, a wick operating shaft rotated for vertically moving the wick, a discharge electrode means including a first discharge electrode and a second discharge electrode which are arranged for generating spark discharge therebetween sufficient to ignite a portion of the wick raised so as to upwardly extend from the space of the wick receiving cylinder structure, an ignition knob pivotally moved for rotating the wick operating shaft in a wick raised direction, and an ignition switch operated depending on pivotal movement of the ignition knob. The ignition switch is rendered open when the ignition knob is between a fire-extinguishing position and a wick raised combustion position and closed when it moved to a wick further-raised position defined beyond the wick raised combustion position. The discharge-type ignition device also includes a return spring for urging the wick to cause the wick moved to the wick further-raised position to be lowered to the wick raised combustion position. The ignition knob is operatively connected to the return spring and actuated to generate spark discharge between the first discharge electrode and the second discharge electrode while raising the wick against the return spring.

In a preferred embodiment of the present invention, the discharge-type ignition device further includes a rotation plate to which the return spring is operatively connected and a stopper with which the rotation plate is engaged at the wick raised combustion position. The rotation plate includes a holding section through which the ignition knob is connected to the rotation plate, the ignition knob is pivotally moved against the return spring so as to be engaged with the stopper when it is pivotally moved for raising the wick, and the rotation plate engaged with said stopper is further pivotally moved beyond the stopper to move the wick to the wick further-raised position, during which spark discharge is generated between the first discharge electrode and the second discharge electrode.

In a preferred embodiment of the present invention, the ignition switch may be operatively connected to the rotation plate, resulting in being operated depending on movement of the rotation plate. Alternatively, the wick operating shaft may include a wick operating lever through which the wick operating shaft is operatively connected to the ignition knob, wherein the ignition switch is operatively connected to the wick operating lever, resulting in being operated depending on movement of the wick operating lever.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a discharge-type ignition device for an oil burner according to the present invention will be described hereinafter with reference to the accompanying drawings.

Figure 1:
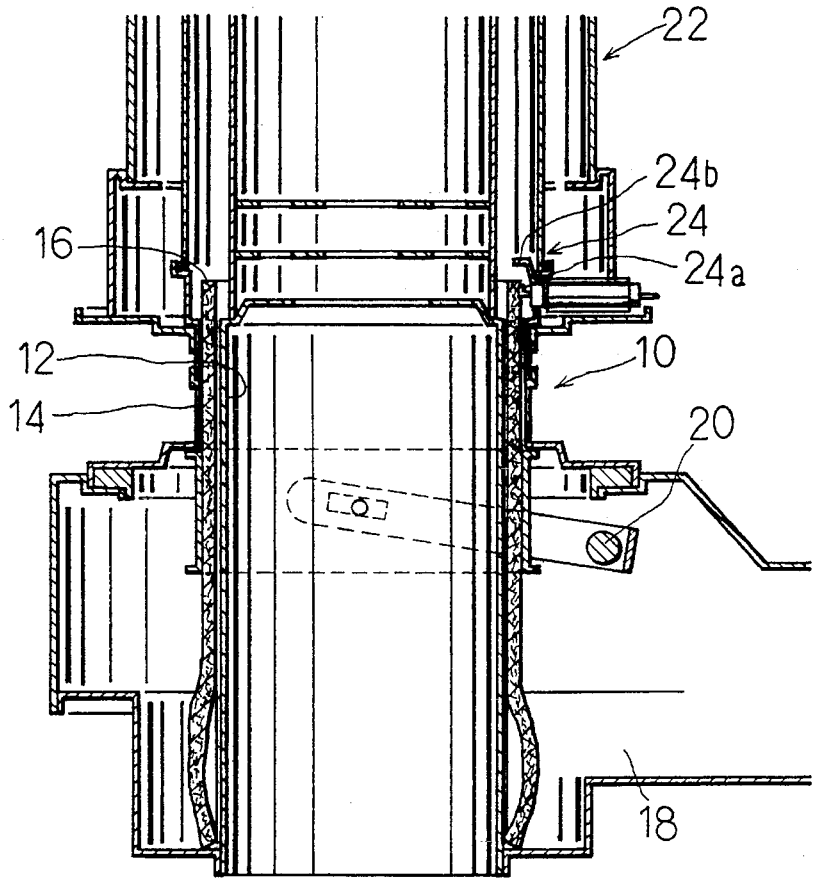
FIG. 1 is a fragmentary vertical sectional showing an example of an oil burner to which a discharge-type ignition device according to the present invention may be applied.
Figure 2:
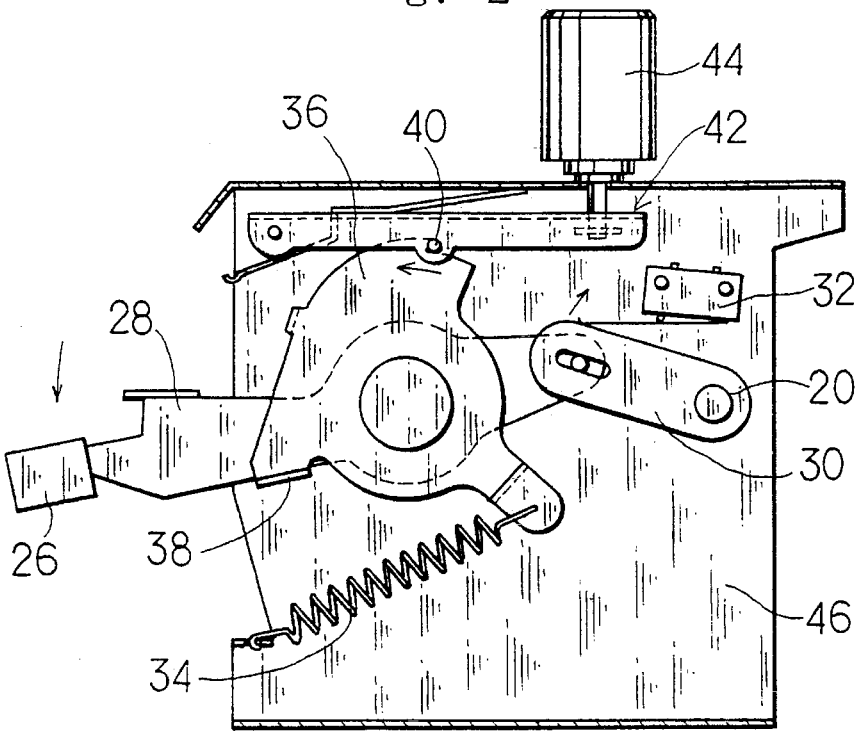
FIG. 2 is a front elevation view showing an essential part of an embodiment of a discharge-type ignition device for an oil burner according to the present invention.
Figure 3:
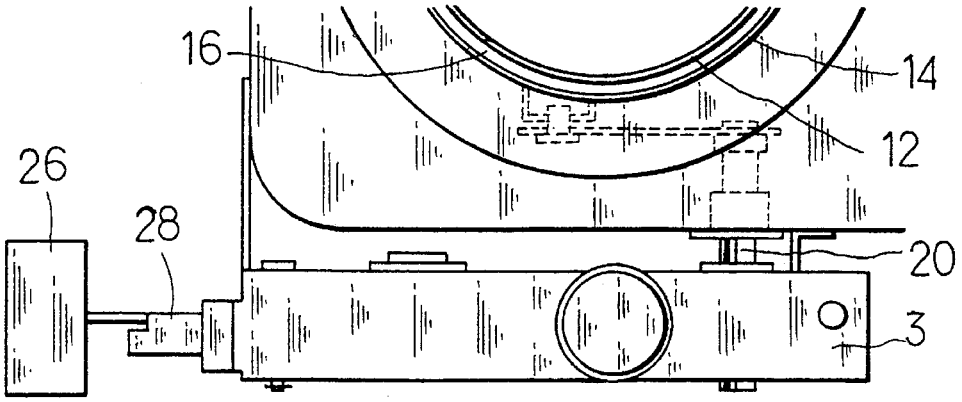
FIG. 3 is a fragmentary plan view of the discharge-type ignition device shown in FIG. 2.

Referring first to FIG. 1, an oil burner to which a discharge-type ignition device according to the present invention may be applied is illustrated by way of example. The oil burner shown in FIG. 1 includes a wick receiving cylinder structure 10 comprising an inner cylindrical member 12 and an outer cylindrical member 14 arranged so as to be radially spaced from each other with a space being defined therebetween. In the thus-formed space of the wick receiving cylinder structure 10 is arranged a wick 16 in a manner to be vertically movable. The wick receiving cylinder structure 10 is mounted substantially on an oil reservoir 18. Reference numeral 20 designates a wick operating shaft, which is adapted to vertically move the wick 16 when it is rotated. On the wick receiving cylinder structure 10 is supported a combustion cylinder structure 22 in which combustion of fuel oil takes place. The above-described construction of the oil burner per se is widely known in the art.

Referring now to FIGS. 2 to 5, an embodiment of a discharge-type ignition device according to the present invention is illustrated, which is so constructed that a wick is moved by lever operation.

Figure 4:
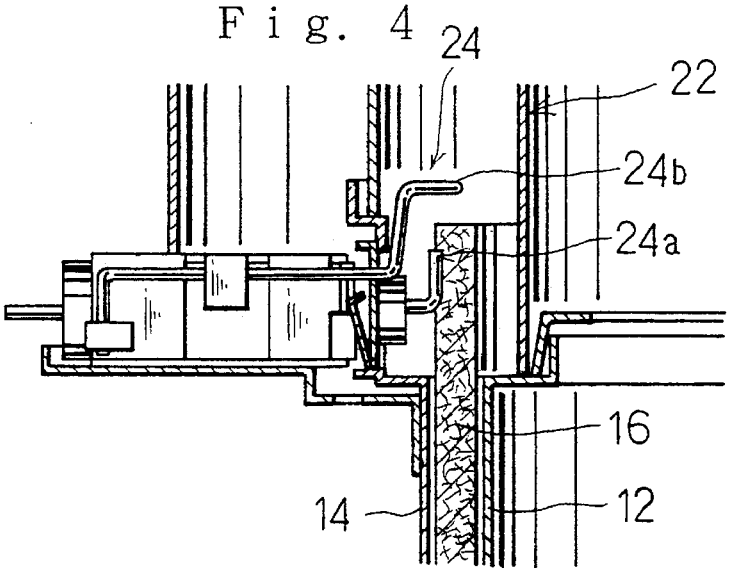
FIG. 4 is a fragmentary enlarged sectional view showing an essential part of a discharge electrode means in the discharge-type ignition device shown in FIG. 2.
Figure 5:
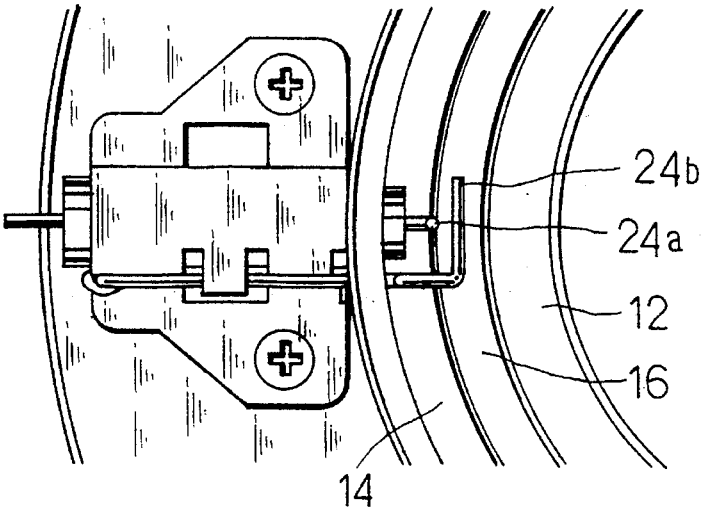
FIG. 5 is a plan view of the discharge electrode means shown in FIG. 4.

A discharge-type ignition device of the illustrated embodiment includes a discharge electrode means 24 which comprises a pair of discharge electrodes or a first discharge electrode **24*a* and a second discharge electrode 24*b*. In the illustrated embodiment, the first discharge electrode 24*a* acts as a positive-side discharge electrode and the second discharge electrode 24*b* acts as a negative-side discharge electrode. As shown in FIG. 4, the first discharge electrode 24*a* is so arranged that a distal end thereof faces a side surface of an upper portion of the wick 16 when the wick is raised to a normal combustion position and the second discharge electrode 24*b* is arranged so as to be opposite to a distal end of the first discharge electrode 24*a* with a gap being formed therebetween and in proximity to an upper end of the wick 16** when it is raised to an uppermost position.

The discharge-type ignition device of the illustrated embodiment also includes an ignition knob 26 for rotating the wick operating shaft 20 in a wick raising direction. The ignition knob 26 is mounted one end of a knob lever 28 which is pivotally moved by operation of the ignition knob 26. The wick operating shaft 20 is mounted thereon with a wick operating lever 30 so that it may be moved with the shaft 20. Thus, in the illustrated embodiment, the knob lever 28 is pivotally moved through the ignition knob 26, so that the wick operating shaft 20 may raise the wick 16.

The discharge-type ignition device of the illustrated embodiment further includes an ignition switch 32 for selectively feed the discharge electrodes **24*a* and 24*b* with electricity. The ignition switch 32 is constructed so as to be operated depending on actuation of the ignition knob 26. More particularly, it is kept open when the ignition knob 26 is between a fire-extinguishing position and a wick raised combustion position and closed when it is moved to a wick further-raised position beyond the wick raised combustion position, to thereby cause electric or spark discharge to start to occur between the first and second discharge electrodes 24*a* and 24*b*. Thus, the illustrated embodiment permits ignition of the wick 16 to be carried out at a position suitable for the ignition while varying a height of the wick 16**.

The discharge-type ignition device of the illustrated embodiment further includes a return spring 34 for forcibly lowering or returning the wick 16 raised to the wick further-raised position for ignition to the wick raised combustion position. For this purpose, the return spring 34 is connected at one end thereof to a rotation plate 36 arranged coaxially with the knob lever 28. The rotation plate 36 is provided thereon with a holding section 38 engaged with the knob lever 28. Thus, in the illustrated embodiment, the knob lever 28 forces the rotation plate 36 through the holding section 38 engaged therewith. In addition, the discharge-type ignition device the oil burner. In the illustrated embodiment, the stopper 40 may comprise a holding shaft of a vibration sensing unit 42. The rotation plate 36 is securely engaged with the stopper 40 when it is moved to the wick raised combustion position; so that even when the wick 16 is raised beyond the wick raised combustion position, the return spring 34 returns the rotation plate 9 to a position at which it is engaged with the stopper 10.

As described above, the ignition switch 32 is operated depending on actuation of the ignition knob 26. More specifically, in the illustrated embodiment, the ignition switch 32 is operated depending on actuation of the wick operating lever 30 operatively connected to the ignition knob 26.

The vibration sensing unit 42 is actuated when it detects vibration of a predetermined magnitude or more such as earthquake and includes a vibration sensing weight 44 acting as a vibration detecting section of the vibration sensing unit 42. In the illustrated embodiment, the return spring 34 serves also as a fire-extinguishing spring for driving the vibration sensing unit 42. More specifically, when the vibration sensing weight 44 detects vibration of a predetermined magnitude or more during a combustion operation of the oil burner, it transmits the vibration to the stopper 40 to disengage the rotation plate 36 from the stopper 40. This results in the return spring 34 acting on the rotation plate 36 to rotate the wick operating shaft 20 from the wick raised combustion position to the fire-extinguishing position, leading to fire-extinguishing of the oil burner. For this purpose, the stopper 40 may be arranged on the vibration sensing unit 42.

Reference numeral 46 designates a support plate for a wick operating unit. In the illustrated embodiment, the wick operating shaft 20, ignition knob 26, rotation plate 36, ignition switch 32 and vibration sensing unit 42 may be mounted on the support plate 46.

Now, the manner of operation of the discharge-type ignition device of the illustrated embodiment thus constructed will be described hereinafter with reference to FIGS. 1 to 5.

When the ignition knob 26 is downwardly moved to rotate the wick operating shaft 20 in the wick raised direction, the wick 16 received in the space between the inner cylindrical member 12 and the outer cylindrical member 14 is raised, resulting in an upper end of the wick 16 being projected upwardly from the space into a lower part of the combustion cylinder structure 22. Then, further operation of the ignition knob 26 permits the ignition switch 32 to be turned on or closed while raising the wick 16, so that spark discharge may continuously occur between the first discharge electrode **24*a* and the second discharge electrode 24*b*, resulting in ignition of the wick 16 being carried out when a gap between the wick being raised and the discharge electrode 24*b*** is optimum for the ignition.

Whereas, the rotation plate 36 which is operatively connected through the holding section 38 to the ignition knob 26 and on which the return spring 34 is mounted is kept engaged with the stopper 40 at the wick raised combustion position. Thus, when the ignition knob 26 is operated, the rotation plate 36 is rotated to the wick further-raised position beyond the wick raised combustion position against the return spring 34, to thereby cause the ignition switch 32 to be closed or turned on. This results in spark discharge occurring between the first discharge electrode **24*a* and the second discharge electrode 24*b*, so that ignition of the wick 16 may be carried out when a gap between the wick being raised and the discharge electrode 24*b*** is optimum for the ignition.

When an operator's hand is released from the ignition knob 26 after ignition of the wick 16 is accomplished, the return spring 34 forcibly elastically returns the wick 16 from the wick further-raised position to the wick raised combustion position and renders the ignition witch 32 open to stop spark discharge between the discharge electrodes **24*a* and 24*b*, so that the wick 16** ignited may continue combustion while being kept at the combustion position.

Thus, it will be noted that the wick 16 is raised to the uppermost position beyond the wick raised combustion position every time when ignition operation takes place, so that ignition of the wick may be positively ensured even when there occurs a variation in height of the wick 16.

Figure 6:
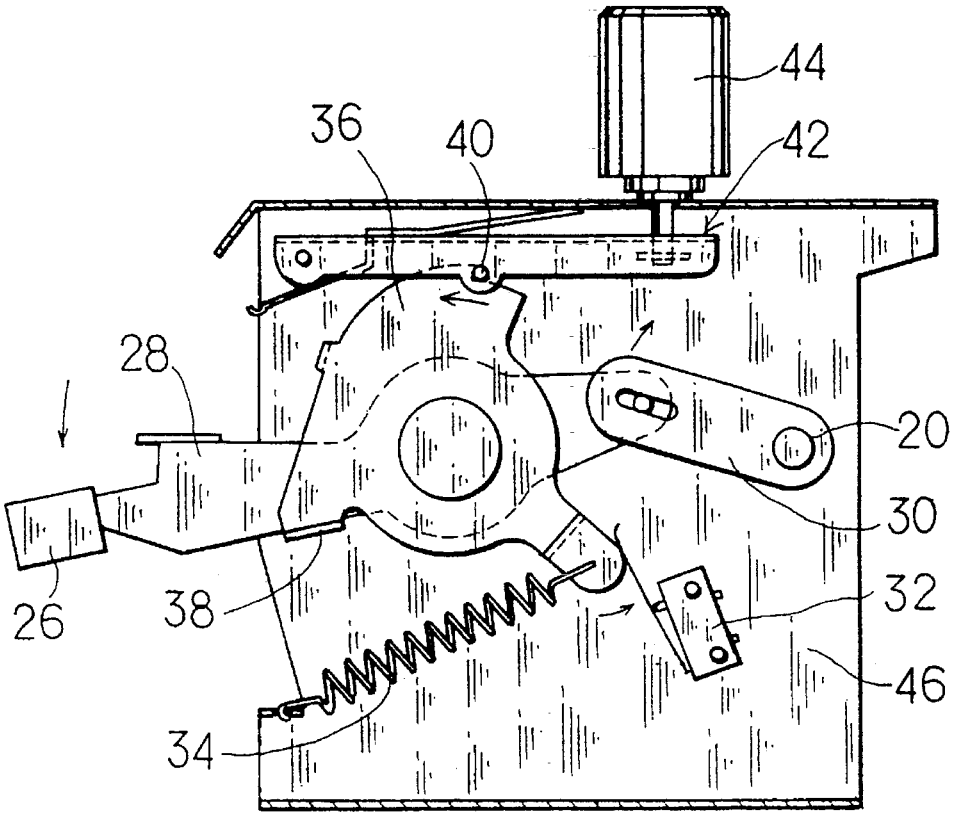
FIG. 6 is a front elevation view showing an essential part of another embodiment of a discharge-type ignition device for an oil burner according to the present invention.

Referring now to FIG. 6, another embodiment of a discharge-type ignition device for an oil burner according to the present invention is illustrated. A discharge-type ignition device of the illustrated embodiment is of the lever-operation type as in the first embodiment described above. In the embodiment of FIG. 6, an ignition switch 32 is likewise operated depending on operation of an ignition knob 26. However, it is operated depending on operation of a rotation plate 36 rather than a wick operating lever 30. For this purpose, the ignition switch 32 is operatively connected to or associated with the rotation plate 36. The remaining part of the embodiment shown in FIG. 6 may be constructed in substantially the same manner as the embodiment described above with reference to FIGS. 2 to 5.

Figure 7:
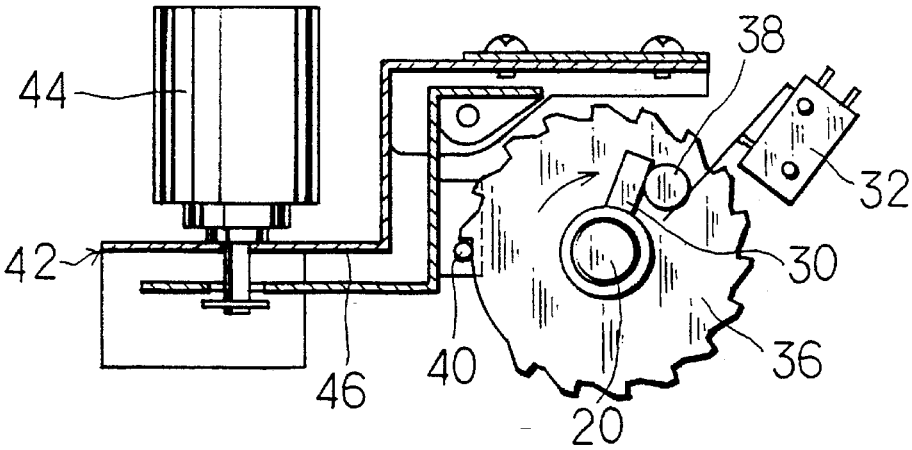
FIG. 7 is a front elevation view in section showing a further embodiment of a discharge-type ignition device for an oil burner according to the present invention.
Figure 8:
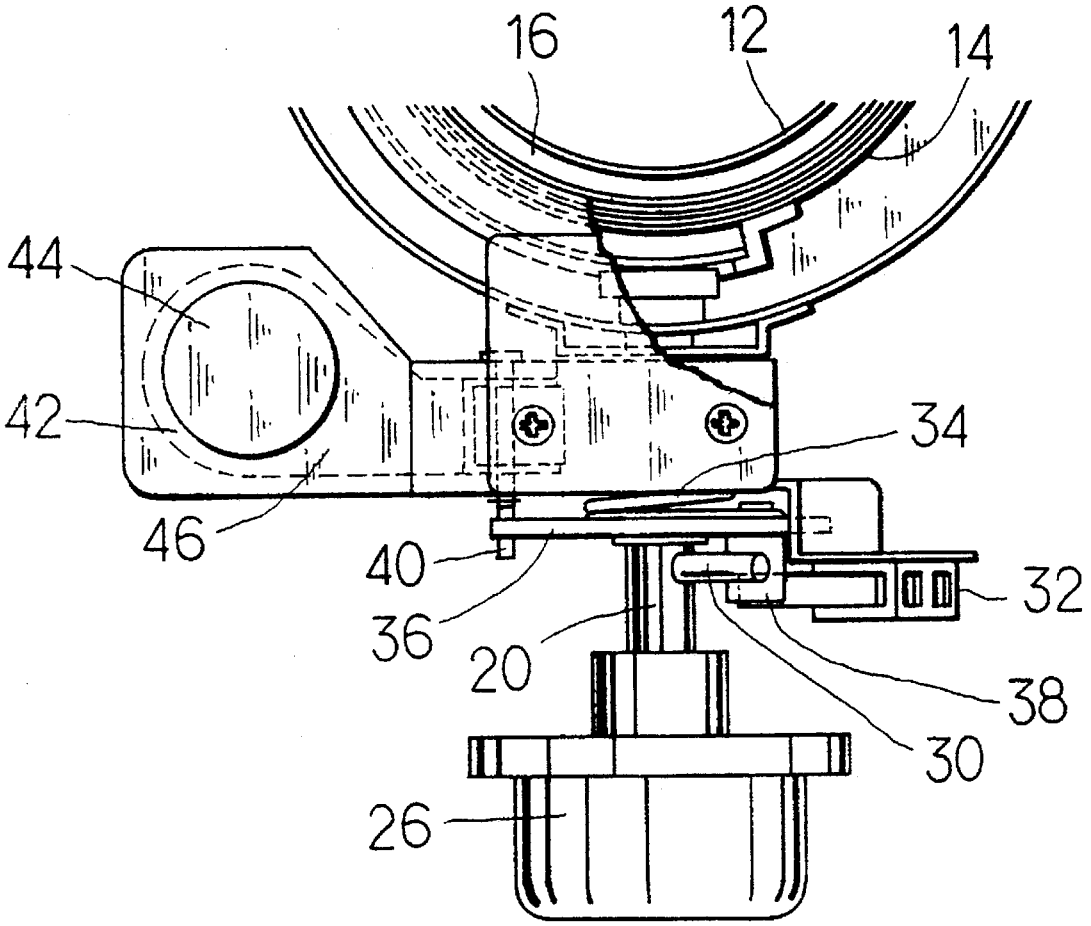
FIG. 8 is a fragmentary plan view of the discharge-type ignition device shown in FIG. 7.

Referring now to FIGS. 7 and 8, a further embodiment of a discharge-type ignition device for an oil burner according to the present invention is illustrated. A discharge-type ignition device of the illustrated embodiment is of the dial-operation type unlike the above-described embodiments. In the embodiments of FIGS. 7 and 8, an ignition knob 26 is rotated to rotate a wick operating shaft 20, to thereby raise a wick 16. Also, a wick operating lever 30 of the wick operating shaft 20 is operatively connected to a holding section 38 of the rotation plate 36, so that the wick operating lever 30 forces the holding section 38 to raise a wick 16 against a return spring 34. Also, an ignition switch 32 is operatively connected to the holding section 38 of the rotation plate 36, resulting in being operated depending on operation of the wick operating lever 30 as in the embodiment shown in FIGS. 2 to 5. The remaining part of the illustrated embodiment may be constructed in substantially the same manner as the embodiment of FIGS. 2 to 5.

As can be seen from the foregoing, the discharge-type ignition device of the present invention is so constructed that spark discharge may be started in the course of raising of the wick. Thus, any possible variation in height of the wick and deformation of the wick due to wear do not adversely affects ignition of the wick, because the ignition is carried out when a gap between the wick being raised and the discharge electrode is rendered optimum for the ignition. This permits a dry cell to be satisfactorily used as a power supply for the ignition.

Also, in the present invention, the ignition switch is kept open or turned off when the wick is at the wick raised combustion position at which normal combustion takes places. Therefore, even if ignition of the wick is failed when it is returned to the combustion position, re-operation of the ignition knob permits the ignition operation to be readily repeated, resulting in the device of the present invention being highly convenient.

In general, a wick of an oil burner is gradually deteriorated with repeated use even when a wick raised position at which normal combustion takes place is kept substantially constant. Such deterioration remarkably occurs at a portion of the wick at which normal combustion takes place. In the present invention, the wick is raised to a position above the wick raised combustion position when the ignition takes place, so that the ignition may be positively accomplished because a portion of the wick at which ignition takes place is positionally different from that of the wick at which combustion takes place.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A discharge-type ignition device for an oil burner which includes a wick receiving cylinder structure including an inner cylindrical member and an outer cylindrical member arranged so as to be spaced from each other with a space being defined therebetween, comprising:

a wick vertically movably arranged in said space of said wick receiving cylinder structure;

a wick operating shaft rotated for vertically moving said wick;

a discharge electrode means including a first discharge electrode and a second discharge electrode which are arranged for generating spark discharge therebetween sufficient to ignite a portion of said wick raised so as to upwardly extend from said space of said wick receiving cylinder structure;

an ignition knob pivotally moved for rotating said wick operating shaft in a wick raised direction;

an ignition switch operated depending on pivotal movement of said ignition knob;

said ignition switch being rendered open when said ignition knob is between a fire-extinguishing position and a wick raised combustion position and closed when it is moved to a wick further-raised position defined beyond the wick raised combustion position; and a return spring for urging said wick to cause said wick moved to the wick further-raised position to be lowered to said wick raised combustion position;

said ignition knob being operatively connected to said return spring;

said ignition knob being actuated to generate spark discharge between said first discharge electrode and said second discharge electrode while raising said wick against said return spring.

2. A discharge-type ignition device as defined in claim 1, further comprising:

a rotation plate to which said return spring is operatively connected; and a stopper with which said rotation plate is engaged at said wick raised combustion position;

said rotation plate including a holding section through which said ignition knob is connected to said rotation plate;

said ignition knob being pivotally moved against said return spring so as to be engaged with said stopper when it is pivotally moved for raising said wick;

said rotation plate engaged with said stopper being further pivotally moved beyond said stopper to move said wick to said wick further-raised position, during which spark discharge is generated between said first discharge electrode and said second discharge electrode.

3. A discharge-type ignition device as defined in claim 2, wherein said ignition switch is operatively connected to said rotation plate, resulting in being operated depending on movement of said rotation plate.

4. A discharge-type ignition device as defined in claim 2, wherein said wick operating shaft includes a wick operating lever through which said wick operating shaft is operatively connected to said ignition knob;

said ignition switch being operatively connected to said wick operating lever, resulting in being operated depending on movement of said wick operating lever.

* * * * *